United States Patent [19]

Feiler

[11] Patent Number: 4,917,235

[45] Date of Patent: Apr. 17, 1990

[54] UNITARY RING DISPLAY SYSTEM

[76] Inventor: Robert J. Feiler, c/o Morel Jewel Displays, Inc., 517 West 29th St., New York, N.Y. 10001

[21] Appl. No.: 241,890

[22] Filed: Sep. 8, 1988

Related U.S. Application Data

[63] Continuation-in-part of Ser. No. 231,359, Aug. 12, 1988.

[51] Int. Cl.[4] ..... B65D 6/04

[52] U.S. Cl. ..... 206/6.1; 206/45.14; 206/566

[58] Field of Search ..... 206/45.11, 45.14, 45.16, 206/45.18, 566, 557, 558, 528; 312/117, 118

[56] References Cited

U.S. PATENT DOCUMENTS

| | | | |
|---|---|---|---|
| 480,045 | 8/1892 | Sommer | 206/45.18 |
| 1,456,613 | 5/1923 | Bartels | 206/558 |
| 1,527,719 | 2/1925 | Wetherell | 206/566 |
| 2,144,968 | 1/1939 | Gerth | 206/566 |
| 4,043,450 | 8/1977 | Rielly | 206/45.14 |

FOREIGN PATENT DOCUMENTS

| | | | |
|---|---|---|---|
| 1270424 | 10/1960 | France | 206/566 |
| 847969 | 9/1960 | United Kingdom | 206/566 |

*Primary Examiner*—David T. Fidei
*Attorney, Agent, or Firm*—Edward Callahan

[57] ABSTRACT

A ring display system for showing rings on a shelf of a showcase including a support structure having a first platform defining a plurality of ring slots for positioning a plurality of rings and a second platform opposed to the first platform for displaying a second plurality of rings. The support structure is movable to either a first ring display position or a second ring display position, the first ring display position being when the first platform is oriented facing upward and the second platform is oriented facing downward, and the second ring display position being when the second platform is oriented facing upward and platform is oriented facing downward so that the support structure can be selectively reversed. The ring display system optionally includes a housing for removably holding the support structure in either the first or the second ring display position. The housing is hollow and has an inner shelf for holding the support structure. The housing and the inner shelf are angled so as to present the first or second platforms at an angle relative to the customer. The housing and the support structure define an inner volume for storing articles.

15 Claims, 8 Drawing Sheets

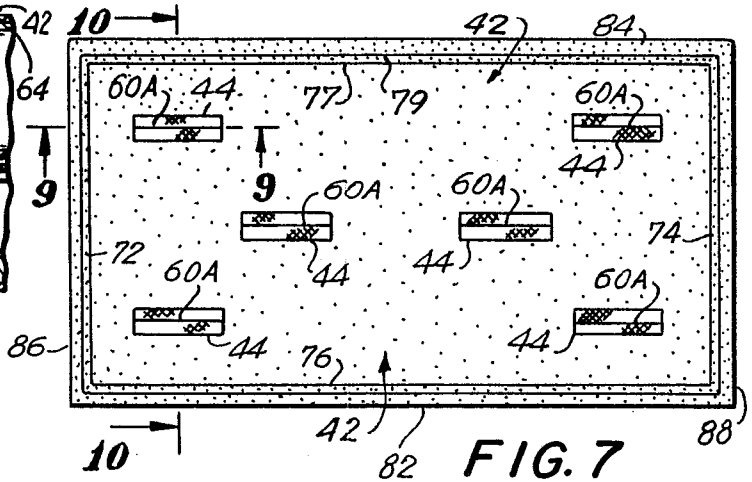
FIG. 7
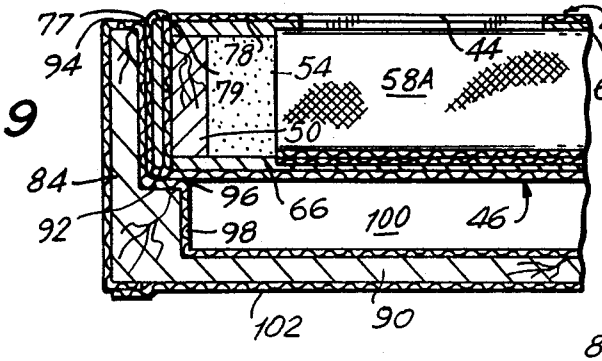
FIG. 9
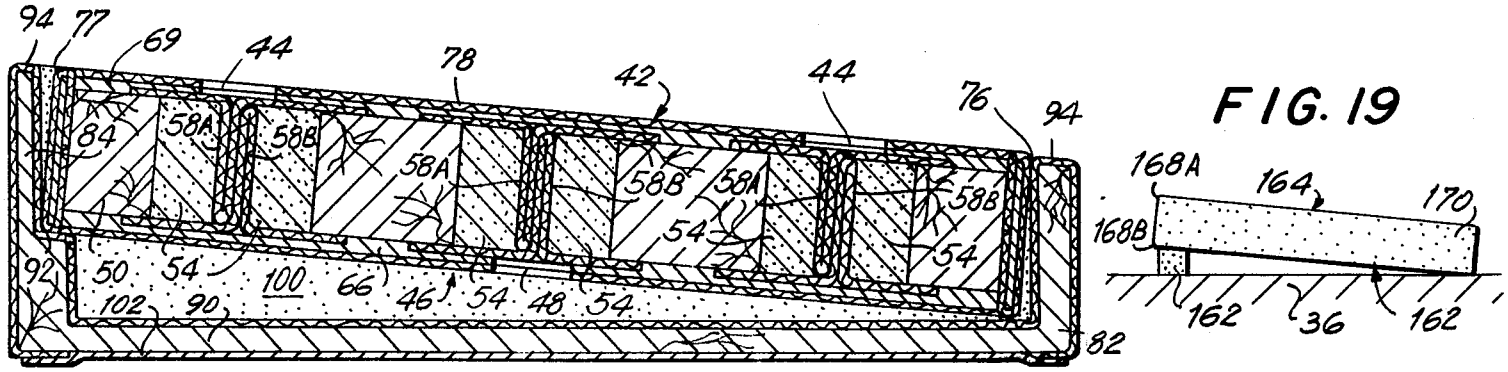
FIG. 19
FIG. 10

UNITARY RING DISPLAY SYSTEM

CROSS-REFERENCE TO RELATED APPLICATION

This application is a continuation-in-part of an application entitled "Unitary Watch Display System", Application No. 231359, filed Aug. 12, 1988.

FIELD OF THE INVENTION

This invention relates generally to the art of jewelry display for retail sale and more specifically to the art of ring display.

BACKGROUND OF THE INVENTION

The art of jewelry display relates to the showing of certain precious commodities in a glass showcase to customers for retail sale purposes. Watches and rings are considered to be among the commodities shown in this manner.

Sales of jewelry including rings increase and decrease sharply in accordance with particular seasons of the year. In particular, during the Christmas season when customer demand is strong, a large number of rings are in inventory and many are displayed in showcases by retailers. Immediately after Christmas, customer demand drops precipitously and merchandise levels are kept low.

Rings displayed for retail sale in glass showcases are mounted on "steps", or "elevations", which in turn rest on the floor of the glass showcase. A number of elevations are positioned adjoining one another. An easel, or tilt support, is generally placed under the elevation at its rear edge so as to present the elevation to customers at a slant. The easels are generally of slightly different sizes so that the elevations are presented at different angular slants. A first type of elevation used for rings in seasons of high merchandise levels has a topside and a back side. The topside is a level platform covered with a fabric and having a number of slots for mounting rings in the season of high merchandise level. The back side has no function and is provided with a backing, generally of paper, which covers over the edges of the fabric covering of the elevation. Because merchants want to avoid having a number of empty ring slots in the seasons of low merchandise levels, a second type of elevation is used. The second type of elevation also has a level topside covered in fabric and has a number of ring slots fewer in number than the topside of the first type of elevation. Like the first type of elevation, the second type of elevation has a backside having no function and provided with a backing, generally of paper, which covers over the edges of the fabric. The second type of elevation has fewer ring slots and thus presents fewer rings than the first type of elevation, although the elevation has all the ring slots filled with rings. Thus, the retailer is able to show an artful display of rings at times of both high and low merchandise levels.

The problem with this system is that two completely different sets of elevations are needed by merchants over the course of a year. One or the other of the sets of elevations must be stored away during their time of non-use, a procedure that has several disadvantages. The major disadvantage is that the environment of the showcase must be disturbed at every change of selling season. Another disadvantage is that the stored elevations may be misplaced and are not available when they are needed. Yet another disadvantage is that convenient space must be found to store the unused sets of elevations.

SUMMARY OF THE INVENTION

Accordingly, it an object of this invention to provide a unitarY ring display system which provides the capability of showing either a high or a low level of ring inventory without disturbing the overall display environment;

It is another object of this invention to provide a unitary ring display system which can be used for times of both high and low merchandise levels; and It is another object of this invention to provide a unitary ring display unit which can be used at times of both high and low merchandise levels.

It is yet another object of this invention to provide a unitary ring display unit which can be turned over when one side of the unit is worn and an unworn side be presented to the public.

In accordance with these an other objects that will become apparent in the course of this disclosure, there is provided a unitary ring display system for showing rings on a shelf of a showcase including a support structure having a support structure having a first platform defining a plurality of ring slots for positioning a plurality of rings and a second platform opposed to the first platform defining a second plurality of ring slots for displaying a second plurality of rings. The support structure is movable to either a first ring display position or a second ring display position, the first ring display position being when the first platform means is oriented facing upward and the second platform means is oriented facing downward, and the second ring display position being when the second platform means is oriented facing upward and platform means is oriented facing downward so that the support structure can be selectively reversed. The ring display system optionally includes a housing for removably holding the support structure in either the first or the second ring display position. The housing is hollow and has an inner shelf for holding the support structure. The housing and the inner shelf are angled so as to present the first or second platforms at an angle relative to the customer. The housing and the support structure define an inner volume for storing articles.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

BRIEF DESCRIPTION OF THE DRAWINGS

FIG. 7 is a top view of the unitary ring display system adapted for a time of high merchandise level;

FIG. 9 is a sectional view taken through line 9—9 of FIG. 7;

FIG. 10 is a top view of the unitary ring display system adapted for a time of low merchandise level;

FIG. 19 is a side view of a unitary ring display support structure in isolation resting on a support block.

DESCRIPTION OF THE PREFERRED EMBODIMENT

Reference is now made in detail to the drawings wherein the same numerals refer to the same or similar elements throughout.

Figure 1:
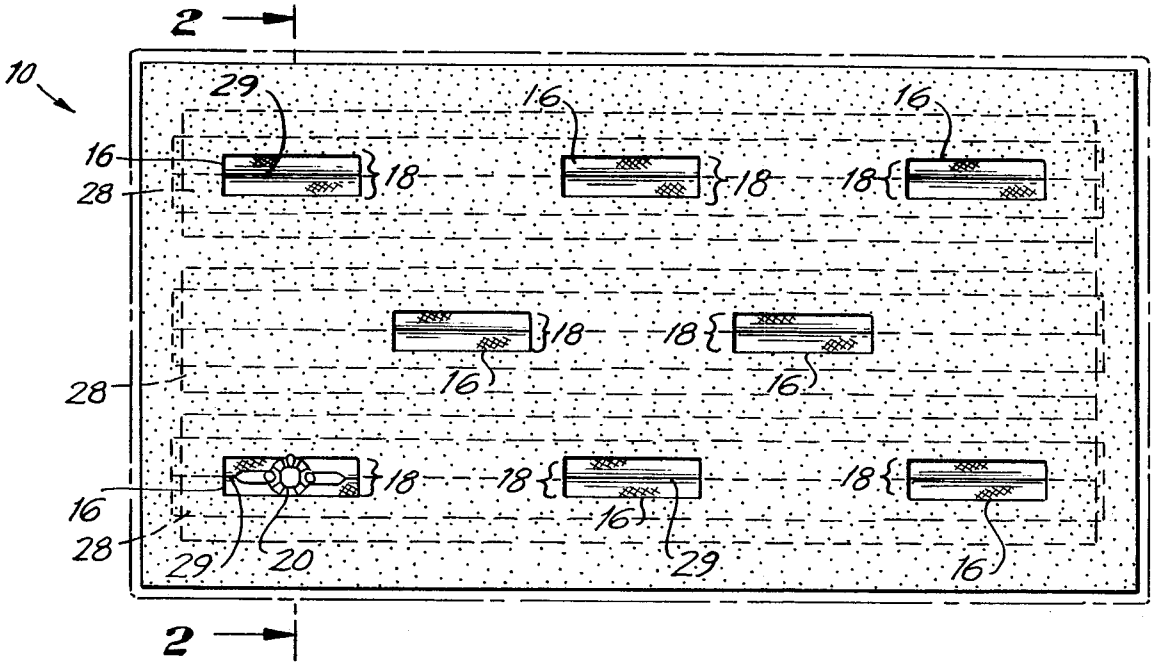
FIG. 1 is is a top view of a typical prior art ring display elevation.
Figure 2:
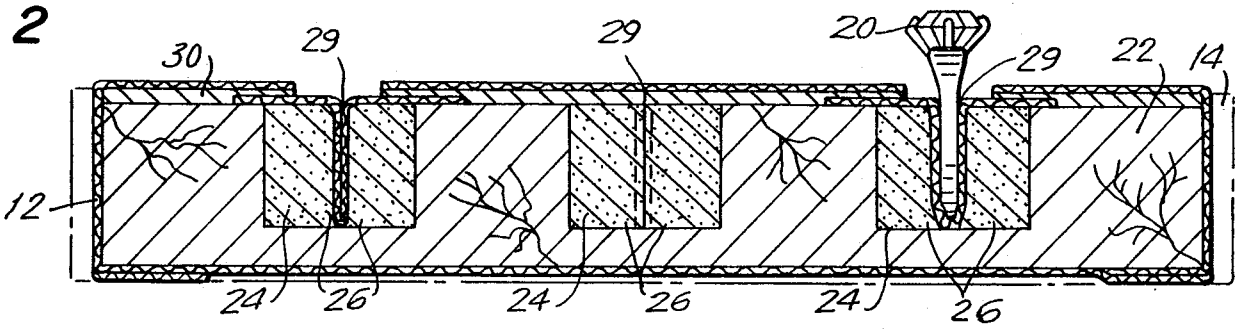
FIG. 2 is a sectional view taken through line 2—2 of FIG. 1.
Figure 3:
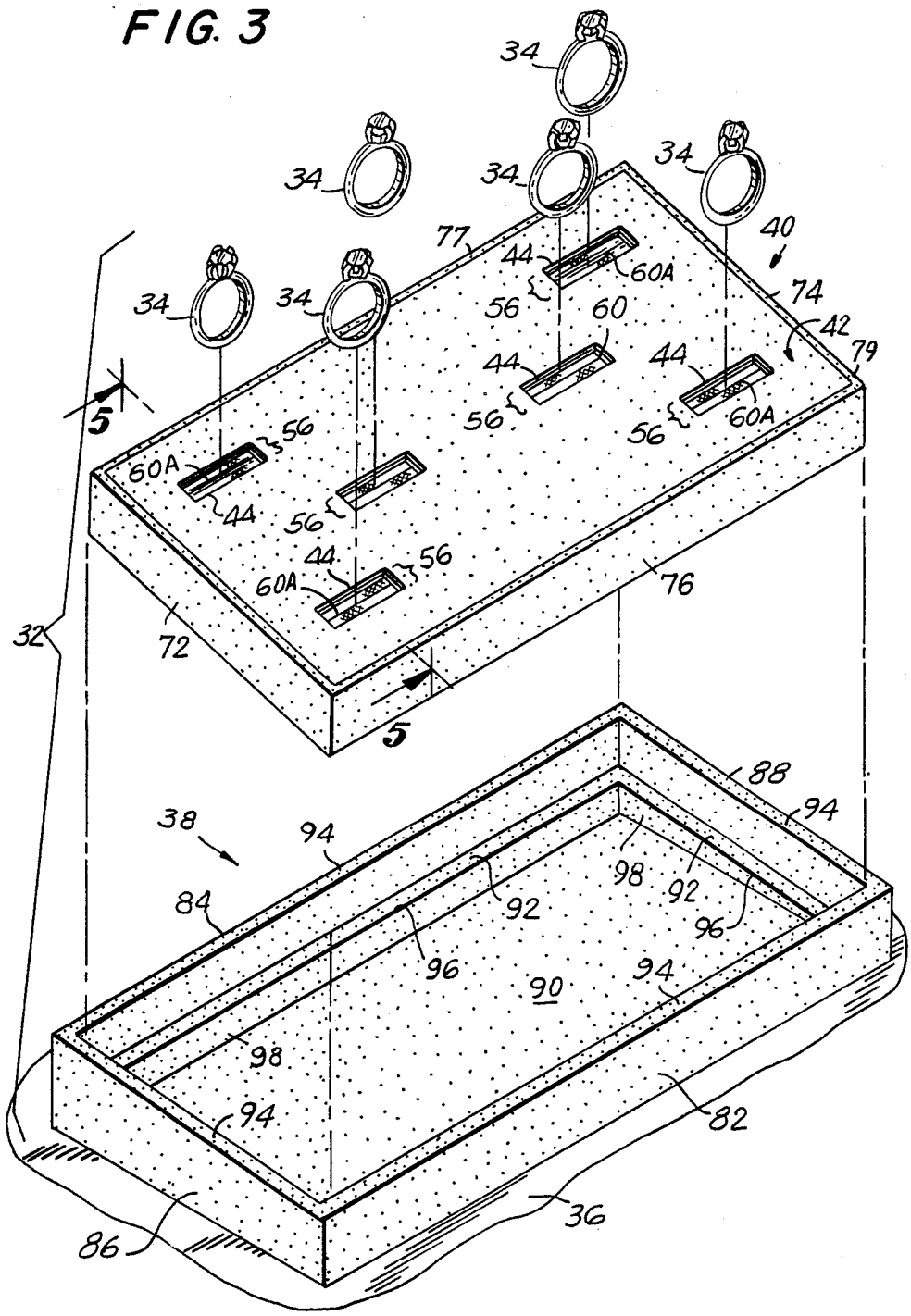
FIG. 3 is an exploded perspective view of a unitary ring display system adapted for display at a time of high merchandise level.
Figure 4:
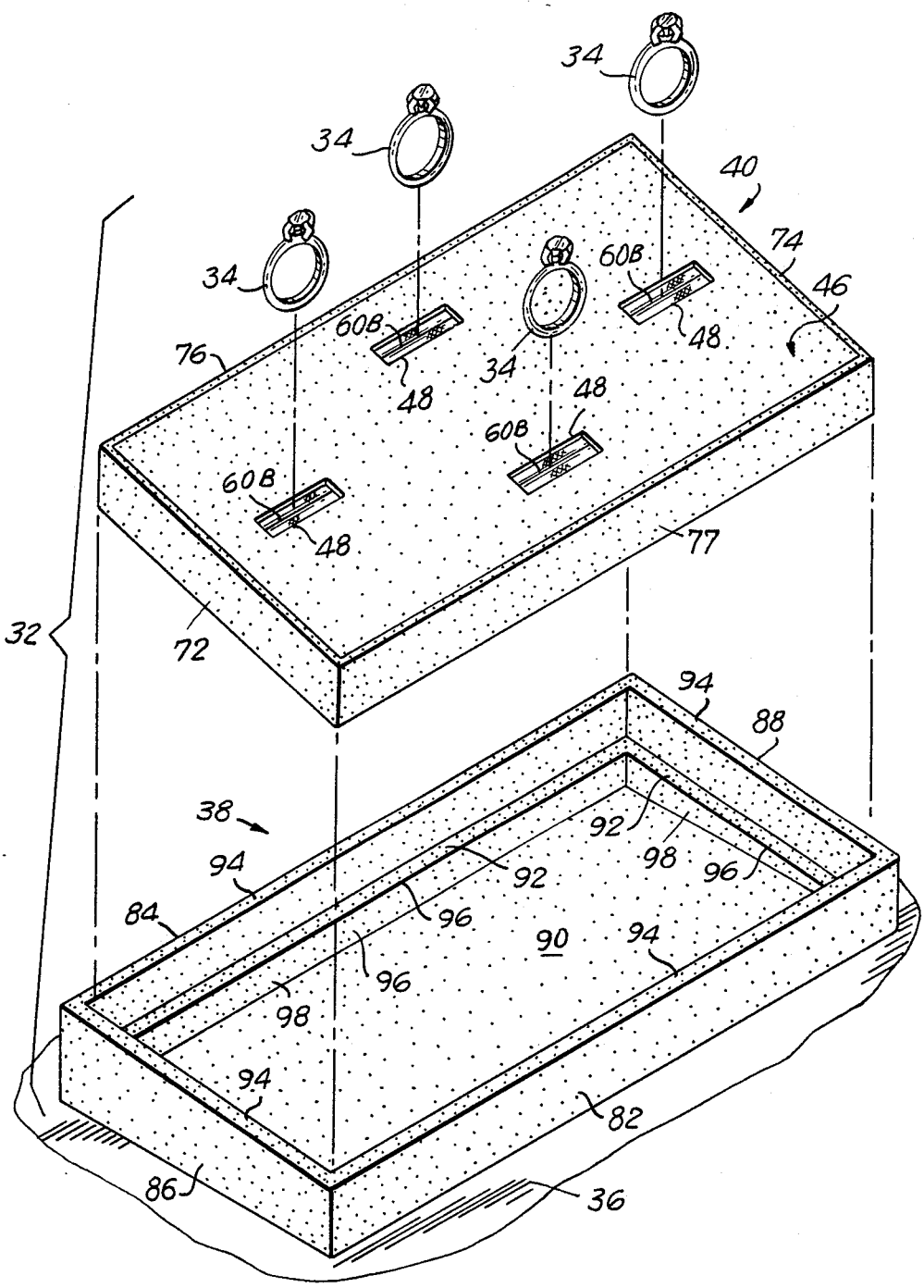
FIG. 4 is an exploded perspective view of the same unitary ring display system illustrated in FIG. 4 for display at a time of low merchandise level.

A typical prior art jewelry display elevation 10 particularly adapted to showing rings is illustrated in FIG. 3. Elevation 10, which is covered by a fabric 12, is optionally positioned in a frame 14, shown in phantom line, and has eight slots 16 opening at the top surface of elevation 10. Fabric 12 has openings that define the openings of the long dimensions, or lengths, of slots 16 and the widths 18 of slots 16. The lengths of slots 16 are oriented generally transverse to the line of sight of a viewer spaced in a regular pattern. One ring 20 is illustrated mounted in a slot 16 but it is to be understood that every slot 16 would generally hold a ring 20. As illustrated in FIGS. 3 and 4, elevation 10 includes a wooden or plastic fixture, or base, 22, which defines three parallel, equally spaced, elongated, rectangular grooves 24, which extend partway into base 22 to a depth sufficient to position rings 20. Grooves 24 are oriented generally transverse to the sightline of a viewer and extend across the width of base 22 to areas slightly spaced from the opposed sides of base 22. Each groove 24 is wider than widths 18 of slots 16. A pair of slightly spaced, elongated, rectangular blocks 26 preferably made of a generally flexible fabric such as bengaline are positioned in each groove 24. Three elongated, biasable grips 28 preferably made of rubber generally T-shaped in cross-section having a separable vertical section are positioned along the entire length of each groove 24 between each pair of blocks 26. Opposed flaps of grips 28 overlie the top of base 22. A gripping space 29 is formed from the vertical separable section of biasable grips 28. A stiffening board 30 is positioned over base 22 and opposed flaps of grips 28. Stiffening board 30 defines five rectangular openings that are coextensive with five slots 16 overlies the top of base 22 and the flaps of grips 28. Rings 20 can be mounted in each slot 16 in gripping spaces 29 when forced apart by rings 20 as illustrated in FIG. 2, wherein each gripping space 29 is slightly less than width 18 of each slot 16. Fabric 12 overlies base 14, grips 28, and stiffening board 30.

In accordance with the present invention, a ring display system 32 for showing rings 34 on a shelf 36 of a showcase is illustrated in exploded perspective in FIGS. 3 and 4. Display system 32 includes a housing 38 and a support structure 40 removably positioned in housing 38. Support structure 40 includes a rectangular, flat first platform 42 (FIG. 3) having six elongated slots 44 opening at the top surface of first platform 42 with their lengths oriented generally transverse to the line of sight of a viewer spaced in a regular pattern for positioning six rings 34, which are also displayed transverse to the line of sight of the viewer. Support structure 40 further includes a rectangular, flat second platform 46 (FIG. 4) opposed to first platform 42 and which has four elongated slots 48 with their lengths oriented generally transverse to the line of sight of a viewer spaced in a regular pattern for positioning four rings 34, which are also displayed generally transverse to the line of sight of the viewer. The number of slots for each platform are illustrated for purposes of exposition only and can vary in accordance with varying demands of the jewelry display industry.

Figure 8:
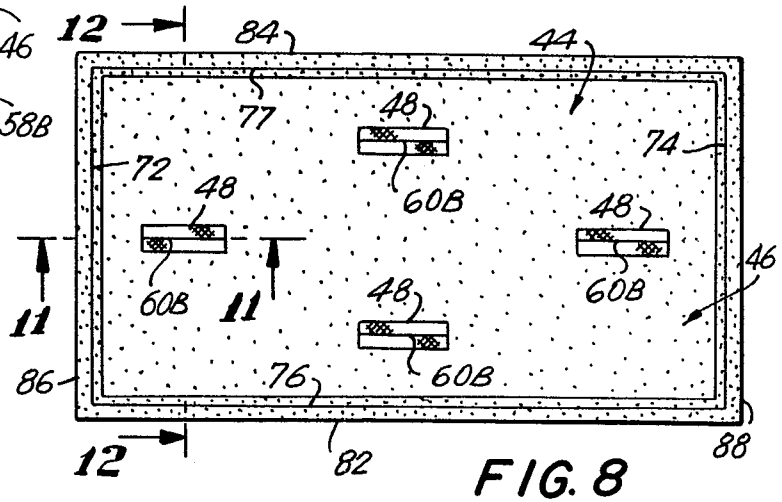
FIG. 8 is a sectional view taken through line 8—8 of FIG. 7.
Figure 11:
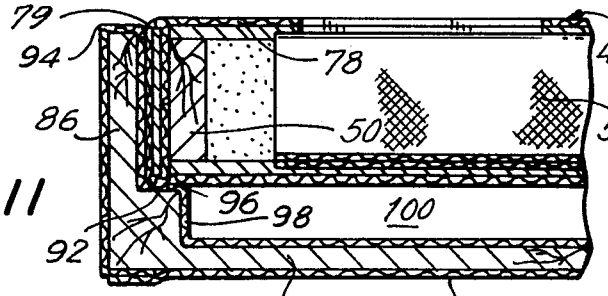
FIG. 11 is a sectional view taken through line 11—11 of FIG. 10.

Support structure 40 is movable by a retailer to either a high, or full, ring display position or a reduced ring display position. The full ring display position is when first platform 42 is oriented facing upward and second platform 46 is oriented facing downward as illustrated in FIGS. 3 and 7. The reduced ring display position is when second platform 46 is oriented facing upward and first platform 42 is oriented facing downward as illustrated in FIGS. 4 and 8. Thus, support structure 40 can be selectively reversed in its position in housing 38 in accordance with either high or reduced merchandise levels, which are in turn seasonal in the jewelry retail field. Support structure 40 is reversed in position by its being manually lifted from housing 38, rotated to its opposite position, and then reset in housing 38.

Figure 5:
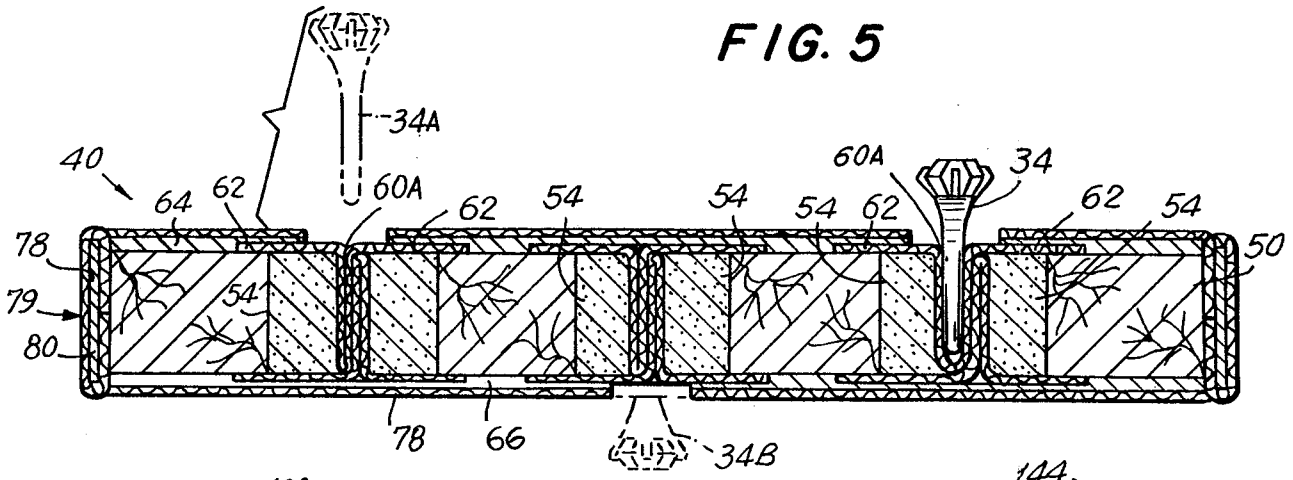
FIG. 5 is a sectional view of the support structure taken in isolation taken through plane 5—5 in FIG. 3.
Figure 6:
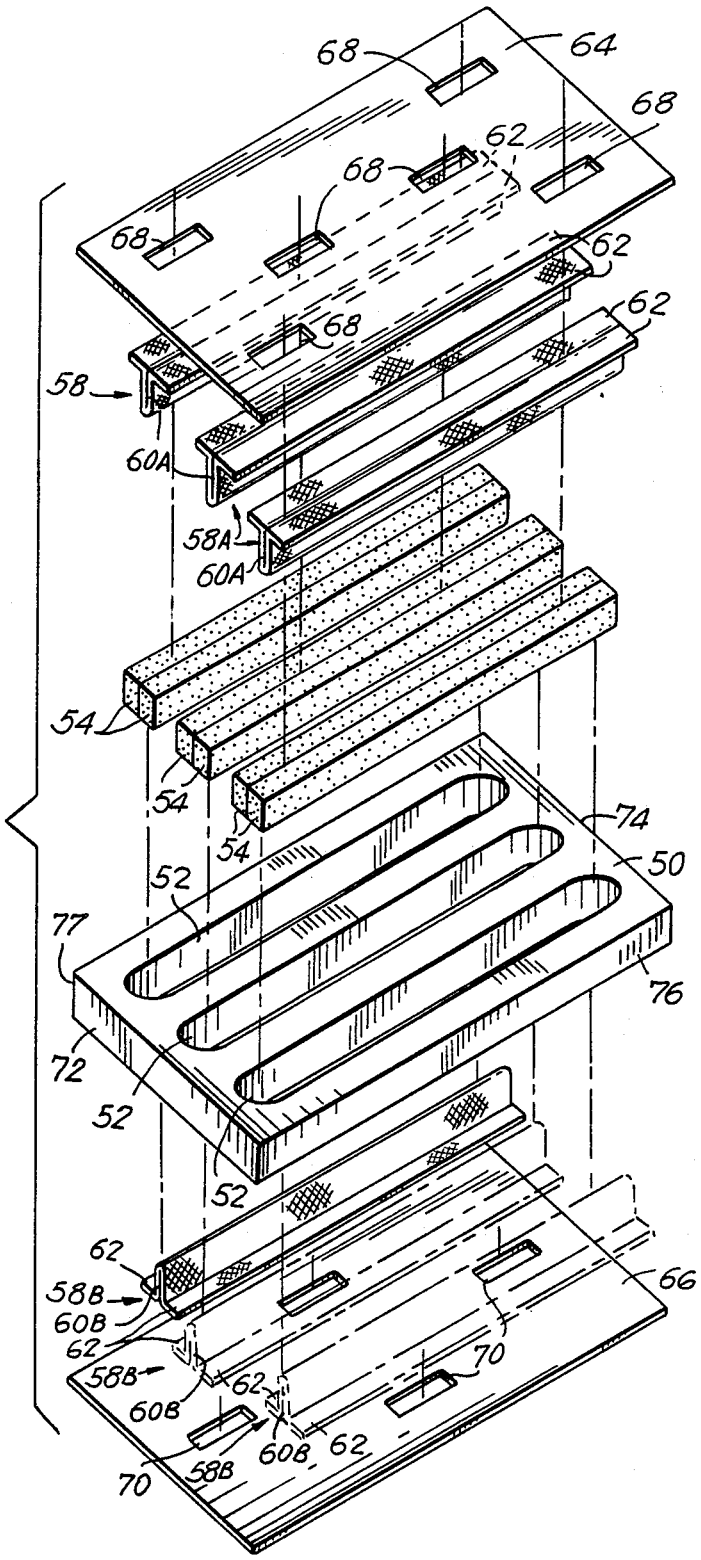
FIG. 6 is an exploded perspective view of the support structure of the unitary ring display system without a covering fabric.

As illustrated in FIGS. 5 and 6, support structure 40 includes a fixture, or base, 50, which is configured as a parallelepiped and is preferably made of wood or plastic. Base 50 defines three parallel, equally spaced, elongated cutouts 52, which extend completely through base 50 with apertures at each first platform 42 and second platform 46. Cutouts 52 are oriented generally transverse to the sightline of a viewer and extend almost the entire width of base 50 to locations proximate to the transverse sides of base 50. A pair of slightly spaced, elongated, rectangular blocks 54 preferably made of a generally flexible fabric such as bengaline are positioned along the length of each cutout 52. Three biasable grips 58A preferably made of rubber generally T-shaped in cross-section having a separable generally vertical section ar positioned in each cutout 52 between each pair of blocks 54. A gripping space 60A is formed in a generally vertical, separable section of each grip 58A with the opening of each gripping space 60A oriented to open at first platform 42 so that a gripping space area of gripping spaces 60A is accessible at each of slots 44. In addition, three biasable grips 58B analogous to biasable grips 58A are likewise positioned in each cutout 52 between each pair of blocks 54 directly adjacent to biasable grips 58A. A gripping space 60B is formed in a generally vertical, separable section of each grip 58B with the opening of each gripping space 60B oriented to open at second platform 46 so that a gripping space area of gripping spaces 60A is accessible at each of slots 48. Rings 34 are shown mounted in slots 44 in gripping spaces 60A at upward facing first platform 42 when the vertical sections are forced apart into a biasable mode by rings 34. A ring 34A is shown in phantom line removed from a slot 44 to illustrate a portion of biasable grip 58A in an unbiased mode before ring 34A is forced into gripping space 60A so as to press the vertical section of biasable grip 58 into a biased mode. A ring 34B is also shown in phantom line mounted in a slot 48 in gripping space 60B at downward facing second platform 46 for purposes of exposition. Generally horizontal connecting flaps 62A and 62B, which are the crossbars of the T of biasable grips 58A and 58B, respectively, are positioned to overlie the outer surfaces of blocks 54 and to be in contact with a portion of the opposed outer surfaces of base 50 in the areas adjoining cutouts 52.

As seen best in FIG. 7, which illustrates display system 32 in its full display position with first platform facing upward, and in FIG. 8, which illustrates display system 32 in its reduced display position with second platform facing upward, two slots 44 and one slot 48 are located in one cutout 52, two slots 44 and and two slots 48 are located in the middle cutout 52, and two slots 44 and one slot 48 are located in the remaining cutout. Because biasable grips 58A and 58B extend the thickness of base 50, that is, through cutouts 52, slots 44 and slots 48 are so positioned as not to interfere with one another. The number of cutouts and slots 44 and 48 can of course be varied in accordance with particular requirements of jewelry retailers.

As illustrated in FIG. 5 and as best seen in FIG. 6, first and second caps, or stiffening boards, 64 and 66, respectively, fitted to the dimensions of the opposed sides of base 50 that conform to first platform 42 and second platform 46, respectively, are positioned to cover the opposed sides of base 50. First board 64 has six rectangular first board slots 68 that conform with the placement of slots 44; and second board 66 has four rectangular second board slots 70 that conform with the placement of slots 48. The lengths and widths of board slots 68 and 70 are coextensive with the lengths and widths of slots 44 and 48. Boards 64 and 66 are made of a stiff, light material such as cardboard.

Base 50 has a pair of opposed side walls 72 and 74 and opposed walls 76 and 77, respectively, shown as front wall 76 and back wall 77 in FIG. 3 and as front wall 77 and back wall 76 in FIG. 4. A fabric 78, such as velvet or faux suede, which is connected to the outer surfaces of first and second boards 64 and 66 in a manner known in the art, for example, by gluing, covers the entirety of base 50 including side walls 72 and 74 and front and back walls 76 and 78. Boards 64 and 66 cover and can be secured to connecting flaps 62A and 62B of biasable grips 58A and 58B by a manner known in the art, for example, by gluing.

Support structure 40 optionally includes a frame 79, which is connected to base 50 at side walls 72 and 74 and opposed walls 76 and 77. Frame 79 includes a stiffener 80 made of a lightweight material such as cardboard and is covered with fabric 78.

As best illustrated in FIGS. 7–12, housing 38 includes opposed vertical front and rear walls 82 and 84, respectively, and opposed vertical left and right side walls 86 and 88, respectively, connected to front and rear walls 82 and 84, and a bottom wall 90 connected to front and rear walls 22 and 84 and side walls 86 and 88. Front and rear walls 82 and 84 and side walls 86 and 88 have inner surfaces, and a continuous rectangular shelf 92 extends transversely inwardly from the inner surfaces. Support structure 40 is positioned in housing 38 on shelf 92 with either first platform 42 or second platform 46 being in contact with shelf 92 depending on the selected position of support structure 40. Front and rear walls 82 and 84 and side walls 86 and 88 include a continuous, rectangular top edge 94 spaced equally from shelf 92. The surface of either first platform 42 or second platform 46 depending on which is oriented facing upward is aligned with top edge 94.

Support structure 40 is optionally positioned in housing 38 so as to rest upon shelf 92 with side walls 72 and 74 of support structure 40 being positioned adjacent to side walls 86 and 88, respectively, of housing 38 when either first or second platforms 42 or 44 are oriented facing upward. Walls 76 and 77 of support structure 40 are positioned adjacent to front and rear walls 82 and 84, respectively, of housing 38 when first platform 42 is oriented facing upward; and walls 77 and 76, respectively, are positioned adjacent to front and rear walls 82 and 84, respectively, when second platform is oriented facing upward. Walls 76 and 77 of support structure are preferably at right angles to side walls 72 and 74 so that walls 76 and 77 are slightly slanted relative the vertical, while front and rear walls 82 and 84 are preferably oriented at the vertical as particularly illustrated in FIGS. 10 and 12. A slight space between wall 76 and walls 82 or 84 and between wall 77 and walls 82 or 84, depending on the orientation of support structure 40, is sufficient to overcome any necessity for a vertical orientation of walls 76 and 77. The angle of support structure 40 relative to showcase shelf 36 is such that the mentioned space is minimal.

Housing 38 is tilted so as to present support structure 40, and more particularly either first platform 42 or second platform 46, at an angle to customers in either the full or reduced display position. In particular, rear wall 84 has a first height and front wall 82 has a second height less than the first height, and side walls 86 and 88 are configured as truncated triangles so that their top edges slant downward from rear wall 84 to front wall 82, so that either first platform 42 or second platform 46 is angled relative to customers depending on which platform is being used for display purposes. Housing 38 is covered with a fabric such as velvet or faux suede.

Figure 12:
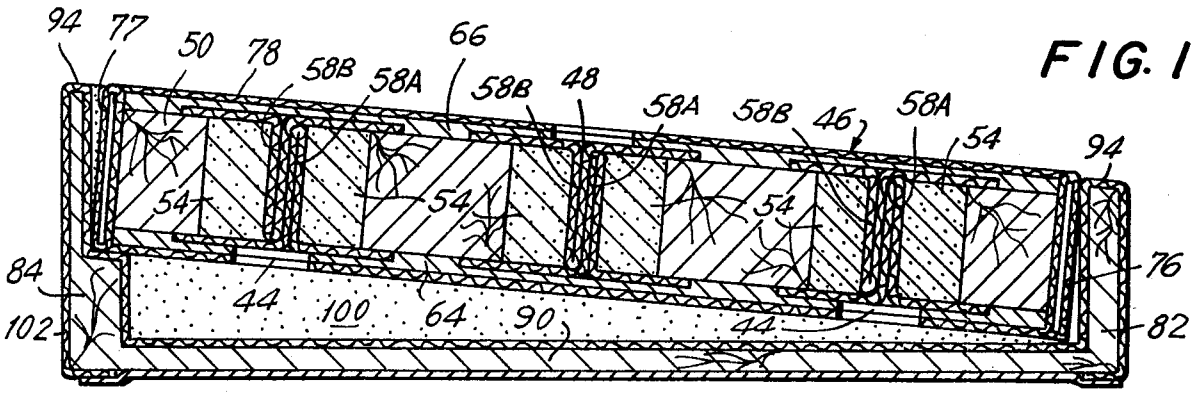
FIG. 12 is a sectional view taken through line 12—12 of FIG. 10.

Shelf 92 includes an inner edge 96 and an inner shelf surface 98 which extends vertically downward from inner edge 96 to bottom wall 90. Vertical shelf surface 98, bottom wall 90, front and rear walls 82 and 84, and either first platform 42 or second platform 46, whichever is facing downward, define a volume 100 in which articles such as rings 34 can be stored, as illustrated in FIGS. 9 and 12.

Figure 13B:
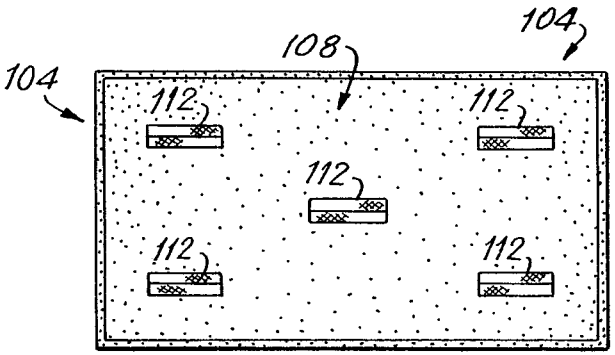
FIG. 13B illustrates the other top view of the unitary ring display system illustrated in FIG. 13A also having five ring slots in the opposite platform of the support structure.
Figure 13A:
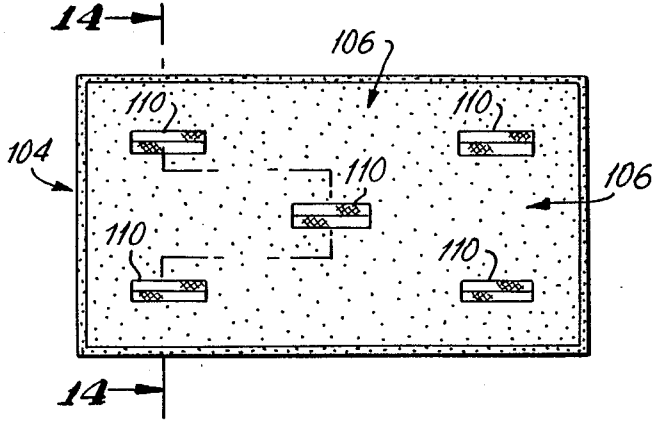
FIG. 13A illustrates one top view of a unitary ring display system having five ring slots in one platform of the support structure.
Figure 14:
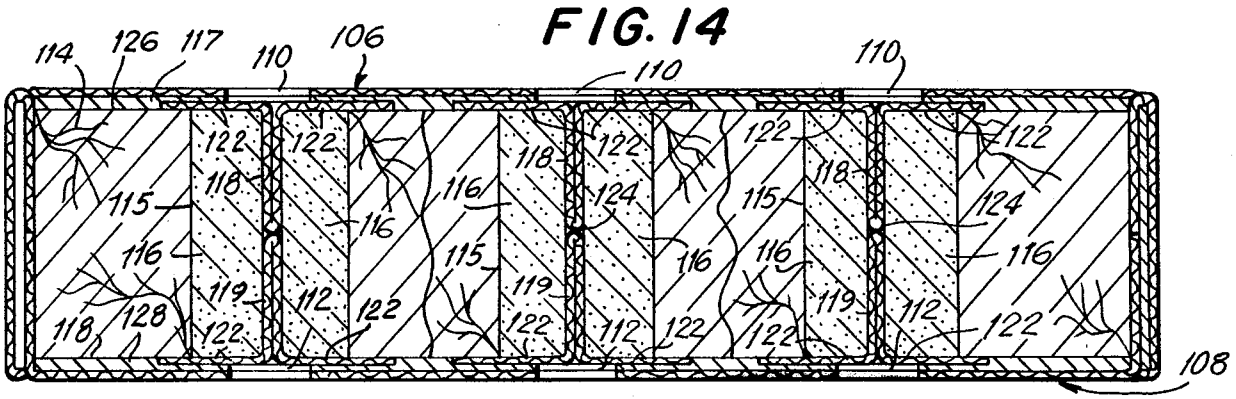
FIG. 14 is a sectional view taken through line 14—14 of FIG. 13A.

A support structure 104 is illustrated in FIGS. 13A and 13B with opposed platforms 106 and 108 facing upwardly, respectively. Support structure 104 is positioned in a housing 105 shown in phantom line. Platform 106 has five ring slots 110 and platform 108 also has five ring slots 112. Rings (not shown) can be mounted in ring slots 110 and 112. Ring slots 110 and 112 are positioned directly opposite one another, as is best illustrated in FIG. 14. The utility of support structure is that one platform can be used to display rings in a showcase until that platform begins to show wear, at which time the jeweler can rotate support structure 104 so as to have the fresh and unused opposed platform face upward.

As illustrated in FIG. 14, platform 104 includes a base 114, which is configured generally as a parallelepiped. Base 114 defines three equally spaced parallel cutouts 115 that extend generally transverse to the line of sight of a viewer. Cutouts 115 extend completely through base 114 to locations proximate to the transversely located sides of base 114. A pair of slightly spaced, elongated, rectangular blocks 116 analogous to blocks 54 previously described are positioned along the transverse length of each cutout 115.

Three elongated, biasable grips 118 are positioned in and extend halfway through the three cutouts 115 in the spaces between pairs of blocks 116; and three elongated, biasable grips 119 are positioned in and extend halfway through cutouts 116 between the spaces between pairs of blocks 118. Biasable grips 118 and 119 are similar in construction to biasable grips 58A and 58B previously described. Biasable grips 118 and 119 have gripping space 120 formed in the vertical, separable section of each biasable grip 118 and 119, which are oriented towards platforms 106 and 108. The opening of each gripping space 120 is oriented to open at slots 110 and 112 at first or second platform 106 or 108.

Biasable grips 118 and 119 include opposed, generally horizontal connecting flaps 120, which are positioned to overlie opposed outer surfaces of blocks 116 and to be in contact with a portion of the opposed outer surfaces of base 114 in the areas adjoining cutouts 115. Each biasable grip 118 is connected to a mating biasable grip 119 by a connecting strip 124 which extends across each cutout 115 midway between platforms 106 and 108. Midway connecting strips 124 can be unitary with biasable grips 118 and 119 or can be made of a soft, flexible material such as a cloth or fabric connected to biasable grips 118 and 119. Connecting strips 124 are the bottom walls of each ring slot 110 and 112 for limiting movement of a ring placed in any ring slot 110 or 112.

Opposed stiffening boards 126 and 128 fitted to the dimensions of the opposed sides of base 114 that conform to platforms 106 and 108 are positioned to cover the opposed sides of base 114. Each board 126 has rectangular board slots that conform with the placement of slots 110; and board 128 has five rectangular board slots that conform with the placement of slots 112. The lengths and widths of the board slots are coextensive with the lengths and widths of slots 110 and 112. Boards 126 and 128 are made of a stiff, light material such as cardboard.

FIGS. 15–19 illustrate four of a number of possible embodiments of unitary display systems.

Figure 15:
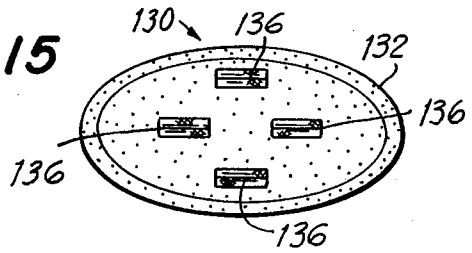
FIG. 15 is a top view of a unitary ring display system configured as an oval.

FIG. 15 illustrates a ring display system 130 configured as an oval as viewed from above, with the long dimension of the oval being transverse to the line of sight of a viewer. Ring display system 130 includes an oval housing 132 constructed and arranged analogous to housing 38 described previously; an oval support structure 134 constructed and arranged analogous to support structure 40 described previously; and four ring slots 136 at the upward facing platform defined by oval support structure 134 and aligned transverse to the line of sight of a viewer. Oval support structure 134 has opposed platforms each either having a different number of ring slots 136 for full and reduced ring displays or having the same number of ring slots 136. The oval configuration of oval ring display system 130 can also have the short dimension of the oval oriented transverse to the line of sight of the viewer.

Figure 16:
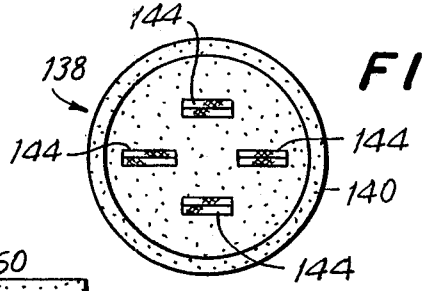
FIG. 16 is a top view of a unitary ring display system configured as an circle.

FIG. 16 illustrates a ring display system 138 configured as an circle when viewed from above. Ring display system 138 includes a circular housing 140 constructed and arranged analogous to housing 38 described previously; a circular support structure 142 constructed and arranged analogous to support structure 40 described previously; and three ring slots 144 at the upward facing platform defined by circular support structure 142 and aligned transverse to the line of sight of a viewer. Circular support structure 142 has opposed platforms each either having a different number of ring slots 144 for full or reduced ring display or having the same number of ring slots 144.

Figure 17:
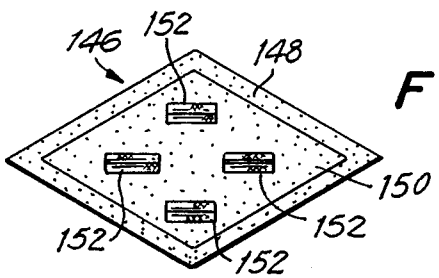
FIG. 17 is a top view of a unitary ring display system configured as a rhombus.

FIG. 17 illustrates a ring display system 146 configured as a rhombus when viewed from above, with the long dimension of the rhombus being transverse to the line of sight of a viewer. Ring display system 146 includes a rhomboid housing 148 constructed and arranged analogous to housing 38 described previously; a rhomboid support structure 150 constructed and arranged analogous to support structure 40 described previously; and five ring slots 152 at the upward facing platform defined by support structure 150 and aligned transverse to the line of sight of a viewer. Rhomboid support structure 150 has opposed platforms each either having a different number of ring slots 152 for full or reduced ring display or having the same number of ring slots 152. The short dimension of the rhombus may be oriented transverse to the line of sight of a viewer.

Figure 18:
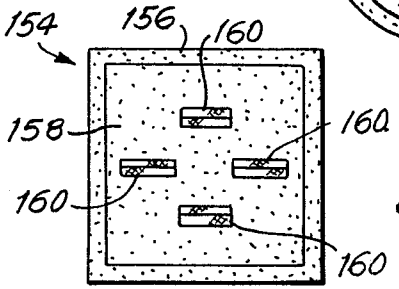
FIG. 18 is a top view of a unitary ring display system configured as a square.

FIG. 18 illustrates a ring display system 154 configured as a square when viewed from above, with the side of the square being transverse to the line of sight of a viewer. Ring display system 154 includes a square housing 156 constructed and arranged analogous to housing 38 described previously; a square support structure 158 constructed and arranged analogous to support structure 40 described previously; and four ring slots 160 at the upward facing platform aligned transverse to the line of sight of a viewer. Square support structure 158 has opposed platforms each either having a different number of ring slots 160 for full or reduced ring display or having the same number of ring ring slots 160. The diagonal of the square may be oriented transverse to the line of sight of a viewer.

An easel, or tilt support, 162 is positioned in contact with showcase shelf 36 and with either a first or second platform 164 or 166 for full or reduced ring display positions, respectively, at either rear bottom edge 168A or 168B of a support structure 170 analogous to support structures 40 or 104 described above. Tilt support 162 elevates the rear portion of support structure 170 in order to present the rings at an angle to the customers.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

What is claimed is:

1. A display system for showing rings on a shelf of a showcase, including, in combination, a support structure, said support structure including first platform means having a first plurality of ring slots for mounting a first plurality of rings, said support structure further including second platform means opposed to said first platform means having a second plurality of ring slots for mounting a second plurality of rings, a first or second plurality of the rings being mountable in said first or said second plurality of ring slots, respectively, a portion of each of the first and said second plurality of the rings extending above said first or said second platform, said support structure being movable between first and second ring display positions, said first ring display position being when said first platform means is oriented facing upward for viewing and said second platform means is oriented facing downward, and said second ring display position being when said second platform means is oriented facing upward for viewing and said first platform means is oriented facing downward, said support structure including a base having opposed first and second sides, said base defining a plurality of parallel cutouts extending through said base and opening at said first and second sides, said first and second sides being adjacent to said first and second platforms, respectively, said first and second plurality of ring slots being located coextensively with said plurality of cutouts, said support structure further including first and second stiffening boards positioned over said first and second sides, respectively, of said base, said stiffening boards defining elongated holes aligned with said first and said second plurality of ring slots, whereby said cutouts are covered except int he areas of said first and second plurality of ring slots, said support structure further including gripping means positioned in said cutouts in alignment with said first and second plurality of ring slots for removably holding the first or second plurality of the rings in said first of second plurality of ring slots, said gripping means including biasable grips defining gripping spaces capable of holding the first and second plurality of the rings in biased relationship when the first or second plurality of the rings is positioned in said first or said second plurality of ring slots, said support structure further including a pair of spaced flexible blocks positioned in each cutout of said plurality of cutouts, said biasable grips being positioned between said pairs of blocks.

2. The display system according to claim 1, wherein said support structure further includes a fabric covering said base including said first and second stiffening boards.

3. The display system according to claim 1, wherein said first plurality of ring slots has the same number of ring slots as said second plurality of ring slots.

4. The display system according to claim 3 wherein said first and said second plurality of ring slots are aligned in pairs between said first and said second platforms.

5. The display system according to claim 4, wherein said biasable grips for said first and said second plurality of ring slots have inner sides located approximately midway through said plurality of cutouts, each biasable strip for each of said pairs of said first and said second ring slots being in adjacent relationship at said inner sides, and further including a bottom wall connected to each said adjacent inner strip, said bottom wall acting to stop the movement of rings mounted into either said first and said second ring slots.

6. The display system according to claim 1, wherein said first plurality of ring slots is greater in number than said second plurality of ring slots, said support structure being movable to either a full ring display position or a reduced ring display position, said full ring display position being when said first platform means is oriented facing upward and said second platform means is oriented facing downward, and said reduced ring display position being when said second platform means is oriented facing upward and said first platform means is oriented facing downward.

7. The display system according to claim 1, further including housing means for removably holding said support structure in either said first or said second ring display position, said housing means including tilt means for presenting said support structure at an angle to the customers in either said full or reduced display position, said housing means further including vertical front and rear walls and opposed vertical side walls connected to said front and rear walls, a bottom wall connected to said front and rear walls and said side walls, said front and rear walls and said side walls having inner surfaces, and a continuous shelf extending transversely inwardly from said inner surfaces, said support structure being positioned in said housing means on said continuous shelf,

8. The display system according to claim 7, wherein said front and rear walls and said side walls include a continuous top edge spaced equally from said continuous shelf.

9. The display system according to claim 8, wherein said tilt means includes said rear wall having a first height and said front wall having a second height greater than said first height, said side walls being configured as truncated triangles.

10. The display system according to claim 9, wherein said continuous shelf includes an inner edge and an inner shelf surface extending vertically downward from said inner edge to said bottom wall, said inner shelf surface, said bottom wall, said front and rear walls, and either said first or second platform defining a volume, whereby articles can be stored in said volume.

11. The display system according to claim 1, wherein said first plurality of ring slots is greater in number than said second plurality of ring slots, said support structure being movable to either a full ring display position or a reduced ring display position, said full ring display position being when said first platform is oriented facing upward and said second platform is oriented facing downward, and said reduced ring display position being when said second platform is oriented facing upward and said first platform is oriented facing downward.

12. A display system for showing rings on a shelf of a showcase, including, in combination, a support structure, said support structure including a first platform having a first plurality of ring slots, said support structure further including a second platform directly opposed to said first platform and having a second plurality of ring slots, said second platform being parallel to said first platform, said support structure further including a continuous wall connecting said first and second platforms, said first and second plurality of ring slots being adapted to mount a first and a second plurality, respectively, of the rings, a portion of each of the first and said second plurality of rings extending above said first and said second platform, respectively, said support structure being movable between first and second ring display positions, said first ring display position being when said first platform is oriented facing upward for viewing and said second platform is oriented facing downward, and said second ring display position being when said second platform is oriented facing upward for viewing and said first platform is oriented facing downward, said support structure being configured as a parallelepiped.

13. The display system according to claim 12, wherein said first plurality of ring slots has the same number of ring slots as said second plurality of ring slots.

14. The display system in accordance with claim 12, further including tilt means for positioning said support structure on the shelf at an angle.

15. The display system according to claim 12, wherein the first plurality of ring slots has a different number of ring slots than said second plurality of ring slots.

* * * * *